United States Patent [19]

Brickeen, Sr.

[11] 4,144,994

[45] Mar. 20, 1979

[54] CLOSURE STRUCTURE FOR CONTAINERS

[75] Inventor: Robert W. Brickeen, Sr., St. Louis, Mo.

[73] Assignee: Container Corporation of America, Chicago, Ill.

[21] Appl. No.: 930,912

[22] Filed: Aug. 4, 1978

[51] Int. Cl.[2] ..... B65D 3/10; B65D 5/00; B65D 41/32

[52] U.S. Cl. ..... 229/5.6; 220/276; 220/277

[58] Field of Search ..... 220/266–273, 220/276, 277; 229/5.5, 5.6; 222/541

[56] References Cited

U.S. PATENT DOCUMENTS

| | | | |
|---|---|---|---|
| 2,119,533 | 6/1938 | Fink | 220/276 |
| 3,322,318 | 5/1967 | Felton, Jr. et al. | 229/5.6 X |
| 3,851,793 | 12/1974 | Brown | 220/270 |

*Primary Examiner*—George T. Hall
*Attorney, Agent, or Firm*—Carpenter & Ostis

[57] ABSTRACT

A closure structure for a container having end closures, one of the end closures being arranged to facilitate opening by a conventional type cutter, the closure being characterized by a diaphragm having an annular area therein with a thickness less than the thickness of the closure material, so that the annular area may be readily pierced and severed.

5 Claims, 5 Drawing Figures

CLOSURE STRUCTURE FOR CONTAINERS

BACKGROUND OF THE INVENTION

1. Field of the Invention

The structure according to the present invention makes it possible to sever the closure of a container body, particularly of the kind having a fibrous container body, without the need of incorporating in the closure the conventional line of weakness.

2. The Prior Art

Structures of the prior art have shown end closures for fibrous container bodies, where the closures have incorporated therein lines of weakness adapted to be fractured by openers of the type having a serrated wheel engaging the beaded flange of the container closure, and incorporating a piercing tool traveling the extent of the line of weakness of the closure.

It has been found that the tool in fact does not always follow the line of weakness, but rather may follow a path spaced from the line of weakness.

Structure for the desired purpose is shown in Ellerbrock U.S. Pat. No. 3,397,809, but it may be noted that the piercing tool shown therein does not always follow the disclosed line of weakness.

SUMMARY OF THE INVENTION

It has been found possible to form a closure without the need of forming an extremely narrow line of weakness therein. In fact, the closure according to this invention is formed in operations making unnecessary the operations of forming the aforesaid line of weakness. As will be disclosed herein, in the forming operation of the closure the central diaphragm spanning the distance between the flange structure is coined in the same operation forming the flange structure. Such coining forms an annular area of a width greater than a mere narrow line of weakness adjacent the flange structure. The annular area has a width of the order of 0.030 inch and a thickness thereat from 0.0025 inch to 0.0030 inch, much less the thickness of the closure material which generally varies from 0.0085 inch to 0.010 inch.

In the forming of metal container closures, some work hardening takes place, and to a considerable extent where the flange structure joins the central diaphragm. In the practice of the invention herein, the adverse effect of such working hardening is minimized by the coining of the diaphragm adjacent the flange structure to provide an annular area of sufficient width with minimal thickness to provide an area capable of ready piercing and cutting throughout the length thereof by a conventional opener of the type having a toothed driving wheel engaging the sealing flange of the container closure.

THE DRAWING

Figure 1:
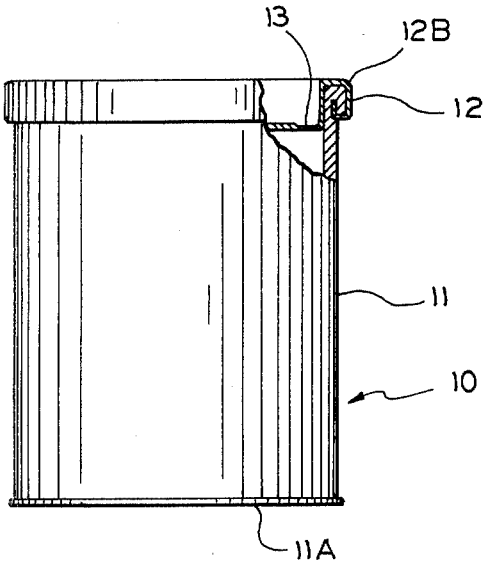
FIG. 1 is an elevational view showing a container having the improvements according to the present invention embodied therein, parts being broken away for details.
Figure 2:
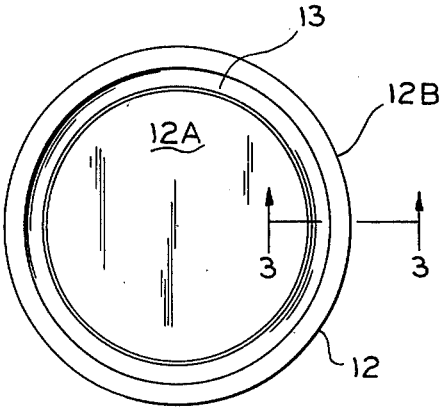
FIG. 2 is a plan view thereof.
Figure 3:
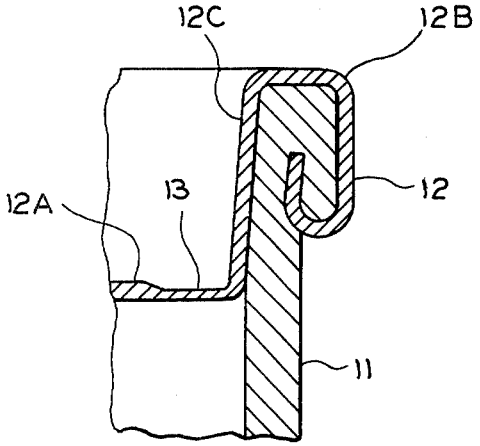
FIG. 3 is an enlarged sectional view taken along the line 3—3 looking in the direction of the arrows.

The invention herein is denoted generally by the reference numeral 10 and is shown in the environment of a container body shell 11 generally made of fibrous material, and having a lower end closure 11A and an upper end closure 12.

The latter has a central diaphragm 12A extending between a peripheral closure flange 12B. The structure thus far described is well known in the art.

According to the present invention, diaphragm 12A is provided with an annular area 13 of reduced thickness as compared to the remaining thickness thereof. Annular area 13 is located in close proximity to an inner wall 12C of closure flange 12B.

Figure 5:
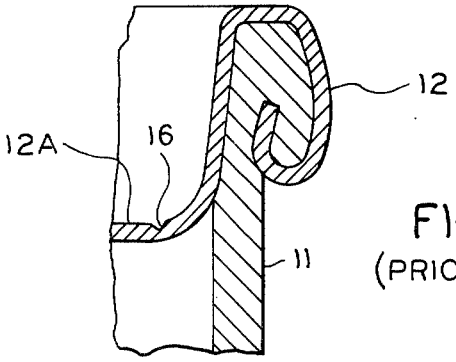
FIG.5 (PRIOR ART)
FIG. 5 is a view similar to FIG. 3 showing the prior art.

Annular area 13 is formed in a coining operation which is done at the same time as the closure 12 is formed so that there is no need for separate operation to form a line of weakness 16 as is seen in FIG. 5, which illustrates the prior art.

The formation of a closure results in a degree of work hardening, but the effect of such formation is greatly minimized by the coining of the annular area 13, which results in thinner metal thereat of the order of 0.0025 inch to 0.0030 inch with a width of the area of the order 0.030 inch. While such coining results in some degree of work hardening, yet the thin metal at area 13 results in lesser resistance to a tool piercing such area and traveling the extent peripherally of the area for removal of the central diaphragm 12A.

Figure 4:
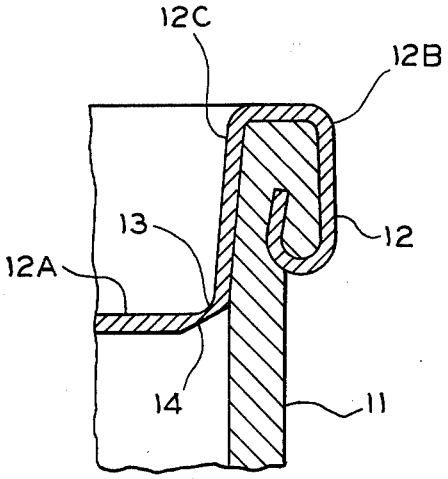
FIG. 4 is a view similar to FIG. 3 showing another embodiment of the invention.

Referring now to FIG. 4 there is shown another embodiment wherein the annular area 13 is formed on a radius of 0.20 inch along the upper face thereof and adjacent wall 12C where it meets diaphragm 12A.

The underside of annular area 13 is formed with an annular surface 14 inclined with respect to the plane of diaphragm 12A. The relationship of area 14 to the radius seen is such as to provide a thickness of from 0.0025 inch to 0.0030 inch, enabling fracture by the conventional opening tool, such as the type having a toothed driving wheel engaging the sealing flange of the closure of a can body.

The width of the annular area at the radius seam including the underneath annular surface may be of the order as previously described.

I claim:

1. A closure structure for a composite container of the type consisting of a fibrous body shell with a pair of end closures closing the ends of said body shell, which closures are seamed to the ends of said body shell, one of said closures being specifically designed to facilitate opening thereof by a conventional type cutter both of the type having a toothed driving wheel and of the type having the conventional piercing element, said closure structure comprising:

(a) a flanged structure closing an end of said body shell;

(b) a diaphragm spanning the distance between said flange structure to define a basic closure structure;

(c) the improvements in said closure structure wherein an annular area of greatly reduced thickness is coined adjacent said flange structure in said diaphragm to facilitate entrance of a tool for severing said diaphragm from said flange structure.

2. The improvements in a closure structure according to claim 1 wherein the width of said annular area is of the order of 0.030 inch.

3. The improvements in a closure structure according to claim 1 wherein the thickness of said snnular area is reduced from the range of 0.0085 inch to 0.010 inch to the range of 0.0025 inch to 0.0030 inch.

4. The improvements in a closure structure according to claim 1 wherein the thickness of said annular area is reduced from the order of 0.0085 inch to 0.010 inch of the thickness of said diaphragm to from 0.0025 inch to 0.0030 inch, and the width of said annular area is of the order of 0.030 inch.

5. The improvements in a closure structure according to claim 1 wherein said diaphragm is coined at the underside thereof with an annular area inclined to the plane thereof adjacent said flange structure and the upper side of said diaphragm is formed with a radius overlying said underside annular area to provide an annular area of thinner cross-section than the thickness of said diaphragm to provide an annular area capable of ready fracture by said piercing element.

* * * * *